US011707742B2

(12) United States Patent
Sleeper et al.

(10) Patent No.: US 11,707,742 B2
(45) Date of Patent: Jul. 25, 2023

(54) REFINER DISC AND HUB ASSEMBLY

(71) Applicant: Valmet Technologies Oy, Espoo (FI)

(72) Inventors: Greg Sleeper, Windham, ME (US); Sanjay Yallure, Maharashtra (IN)

(73) Assignee: Valmet Technologies Oy, Espoo (FI)

( * ) Notice: Subject to any disclaimer, the term of this patent is extended or adjusted under 35 U.S.C. 154(b) by 272 days.

(21) Appl. No.: 17/103,398

(22) Filed: Nov. 24, 2020

(65) Prior Publication Data

US 2022/0161267 A1 May 26, 2022

(51) Int. Cl.

| | |
|---|---|
| ***B02C 7/12*** | (2006.01) |
| ***D21D 1/30*** | (2006.01) |
| *B02C 7/06* | (2006.01) |

(52) U.S. Cl.

CPC ..... *B02C 7/12* (2013.01); *D21D 1/303* (2013.01); *D21D 1/306* (2013.01); *B02C 7/06* (2013.01)

(58) Field of Classification Search

CPC . B02C 7/12; D21D 1/30; D21D 1/303; D21D 1/306

See application file for complete search history.

(56) References Cited

U.S. PATENT DOCUMENTS

| | | | | | |
|---|---|---|---|---|---|
| 3,984,057 | A | | 10/1976 | Pilao | |
| 4,531,681 | A | * | 7/1985 | Matthew | D21D 1/303 241/261.3 |
| 4,570,862 | A | * | 2/1986 | Kirchner | B02C 7/14 241/297 |
| 4,620,675 | A | * | 11/1986 | Kirchner | D21D 1/306 241/261.3 |
| 4,783,014 | A | * | 11/1988 | Fredriksson | D21D 1/303 241/290 |
| 5,707,016 | A | * | 1/1998 | Witsken | D21D 1/303 241/261.3 |
| 5,762,275 | A | * | 6/1998 | Aikawa | D21D 1/303 241/297 |
| 5,934,585 | A | * | 8/1999 | Chaney | D21D 1/30 241/261.2 |
| 6,053,440 | A | * | 4/2000 | LaRiviere | D21D 1/303 241/261.3 |
| 8,944,074 | B2 | * | 2/2015 | Bullins | B02C 7/00 131/311 |
| 2004/0149844 | A1 | * | 8/2004 | Antensteiner | D21D 1/306 241/298 |
| 2004/0182959 | A1 | * | 9/2004 | Chase, Jr. | D21D 1/303 241/261.2 |
| 2006/0037728 | A1 | | 2/2006 | Tempesta | |
| 2011/0271969 | A1 | | 11/2011 | Bullins | |
| 2020/0385926 | A1 | * | 12/2020 | Short | D21D 1/306 |

* cited by examiner

*Primary Examiner* — Faye Francis

(74) *Attorney, Agent, or Firm* — James Earl Lowe, Jr.

(57) ABSTRACT

An assembly comprising an annular hub with a hub inner surface and a hub outer surface and a rotary third refining member having a central opening within a refining member inner surface. The refining member has at least two equally spaced apart member portions extending radially inwardly from the member inner surface, and the assembly includes a key for connecting the member portions to the hub. The assembly also include an annular cover plate with at least two radially extending spaced apart flanges, each flange overlying a member portion, and at least two spaced apart port plates, each port plate overlying a member portion side opposite the annular cover plate, the spaces between the at least two port plates defining ports from a first stock flow path to a second stock flow path.

11 Claims, 8 Drawing Sheets

REFINER DISC AND HUB ASSEMBLY

BACKGROUND

The present disclosure relates to refiners for wood pulp or the like, and more particularly to improvements in refiners wherein stationary refining plates flank rotary refining plates in the chamber of a housing whose inlet admits stock for treatment by comminuting projections (e.g., ribs) on the neighboring surfaces of stationary refining plates and rotary refining plates.

It is already known to utilize in a disc or rotor refiner two coaxial or eccentric plates or discs each of which is driven by a discrete prime mover and which have neighboring surfaces provided with ribs or otherwise configured projections which comminute the material to be treated while the material advances from the inlet toward the outlet of the stock chamber. It is further known to use a pair of discs one of which is stationary and the other of which rotates relative to the stationary disc.

It is also known to dispose two rotary discs between two stationary discs so that each rotary disc cooperates with a different stationary disc. The rotary discs are mounted at the opposite sides of a disc-shaped carrier which is driven by a shaft. The stock is fed through one of the stationary discs to enter the space between the one stationary disc and the respective rotary disc, and some of the stock is allowed to pass through relatively small openings in the rotary discs to enter the space between the other rotary disc and the other stationary disc.

The openings though the rotary disc are usually sized for high stock flow. In some instances, however, lower stock flow is required. In this instance, too much stock can flow through the rotary disc and thus cause unequal flow on both sides of the disc. In conventional applications, an annular ring has been added to the inlet side of the rotary disc to reduce the size of the openings. This annular disc adds to the weight of the rotary disc and further reduces the flow area through the inlet stock passageway. The annular disc also covers portions of the rotary refining member other than the ports, thus adding further unnecessary metal and weight to the refining member. It has also been known to weld plates over a portion of the ports in order to reduce the port sizes.

A better approach to allow for adjustment of the stock flow openings is needed.

SUMMARY

Disclosed is an assembly comprising an annular hub with a hub inner surface and a hub outer surface and a rotary third refining member having a central opening defined by a refining member inner surface. The refining member has at least two equally spaced apart member portions extending radially inwardly from the member inner surface, and the assembly includes a key for connecting the member portions to the hub. The assembly also include an annular cover plate with at least two radially extending spaced apart flanges, each flange overlying a member portion, and at least two spaced apart port plates, each port plate overlying a member portion side opposite the annular cover plate, the spaces between the at least two port plates defining ports from a first stock flow path to a second stock flow path.

Figure 1:
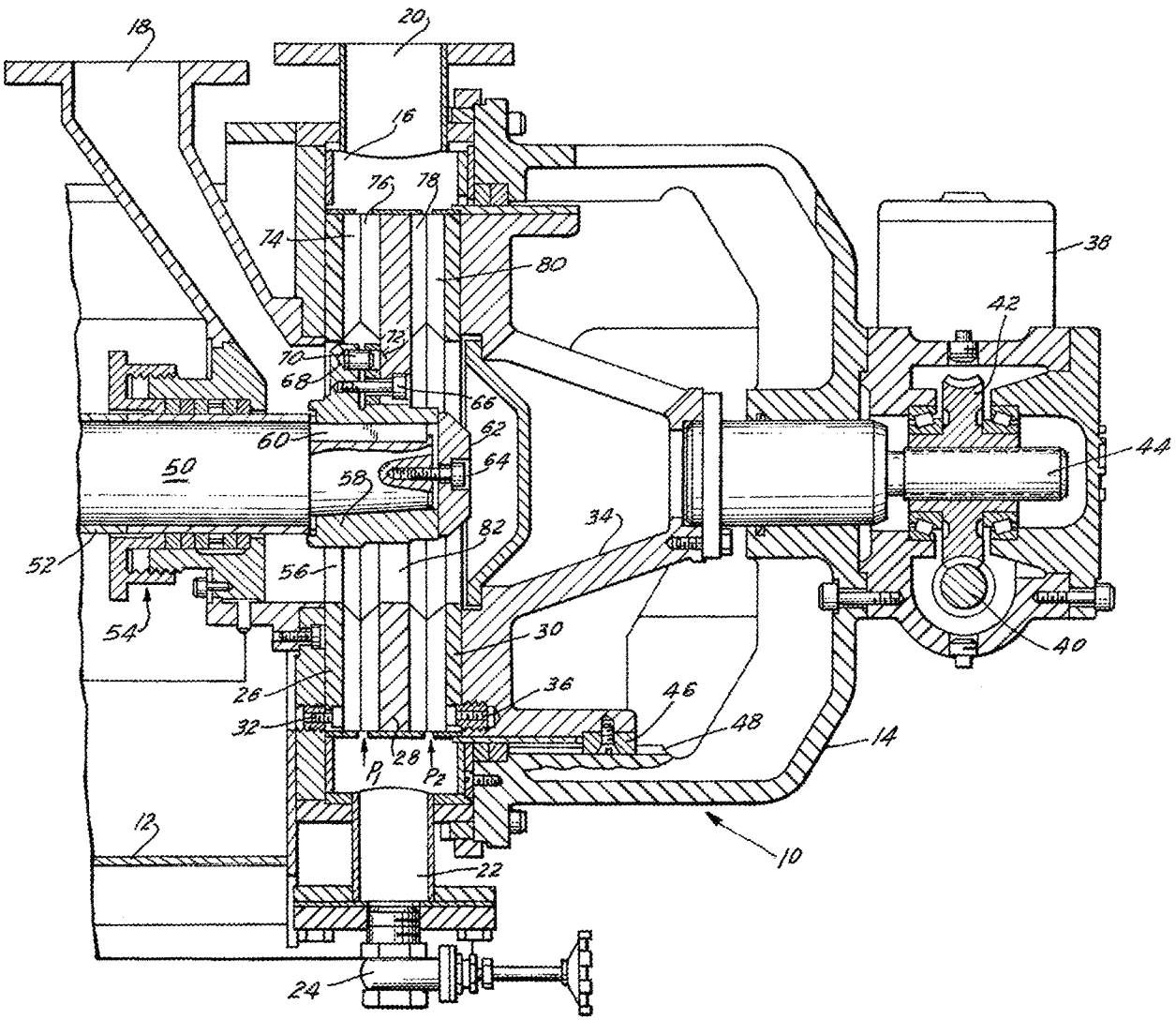
FIG. 1 Prior Art
FIG. 1 is a fragmentary longitudinal vertical sectional view of a conventional refiner.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF AN EMBODIMENT

Elements in Common with the Prior Art

Referring first to FIG. 1, there is shown a prior art disc refiner having a housing 10 including several bolted-together sections two of which are shown at 12 and 14. The description of FIGS. 1 through 5 comes from one such prior art construction, as shown in Pilao U.S. Pat. No. 3,984,057. The housing defines a stock chamber 16 and has an inlet 18 for admission of pulp, e.g., from the outlet of a pump, a first outlet 20 for evacuation of refined pulp, at least in part under the action of centrifugal force, and a second outlet 22 which is normally closed by a suitable valve 24. The outlet 20 extends upwardly and the outlet 22 extends downwardly; the valve 24 is opened when the attendants wish to drain the liquid carrier for wood chips or the like from the chamber 16.

The chamber 16 accommodates a first refining member 26, a second refining member 30, and a third refining member 28, here shown as coaxial discs having identical outer diameters. In other embodiments (not shown), two back-to-back discs can be used instead of the single disc 28. In still other embodiments (not shown), additional disc sets can be used. In still other embodiments (not shown), the refining members may constitute cones or other types of refining members.

The disc 26 is stationary and is fixedly secured to the housing section 12 by screws 32 or analogous fasteners. The disc 30 does not rotate. This disc is spaced apart from the disc 26 and is secured to an axially movable support 34 by means of screws 36 or the like. The support 34 is mounted in the housing section 14 and is movable axially of the discs 26, 28 by a reversible electric motor 38 which can drive a worm 40. The latter meshes with a worm wheel 42 having internal threads in mesh with external threads at the right-hand end of a spindle 44 which is rigid with the support 34. The support 34 has one or more radial projections or followers 46 slidable in elongated grooves 48 of the housing section 14. The grooves 48 are parallel to the common axis of the discs 26, 28 and 30. In other embodiments, other mechanisms for supporting the disc 30 can be used.

The disc 28 is rotatable relative to and is movable axially between the discs 26 and 30. The means for rotating the disc 28 comprises a drive shaft 50 which rotates in a sleeve 52 in the housing section 12. The sleeve 52 is surrounded by a stuffing box 54 which prevents the escape of pulp from the chamber 16 into the left-hand portion of the housing section 12. That end portion of the shaft 50 which extends from the housing section 12 preferably carries a pulley or sprocket wheel driven by an electric motor or another suitable prime mover through the medium of an endless belt or chain. Other types of transmissions between the prime mover and the shaft 50 can be used with equal advantage.

The disc 26 has a relatively large central opening 56 which communicates with the inlet 18 and surrounds the shaft 50 with a substantial amount of clearance. That end portion of the shaft 50 which extends beyond the opening 56 and into the central part of the chamber 16 carries a hub 58 which is secured thereto by a key 60, a cap 62 and a screw 64 so that the hub 58 shares all angular movements of the shaft 50. The hub 58 transmits torque to the centrally located disc 28 by way of several screws 66 but the disc 28 has limited freedom of axial movement relative to the hubs 58 and screws 66. The hub is provided with an eccentric blind bore 68 for a torque transmitting guide pin 70, a portion of which extends into an aligned blind bore 72 of the disc 28. It can be said that the disc 28 "floats" between the discs 26, 30 and automatically finds a central position between the stationary discs 26, 30, not only in response to wear on the surfaces of comminuting projections on the discs but also upon axial adjustment of the disc 30.

Figure 2:
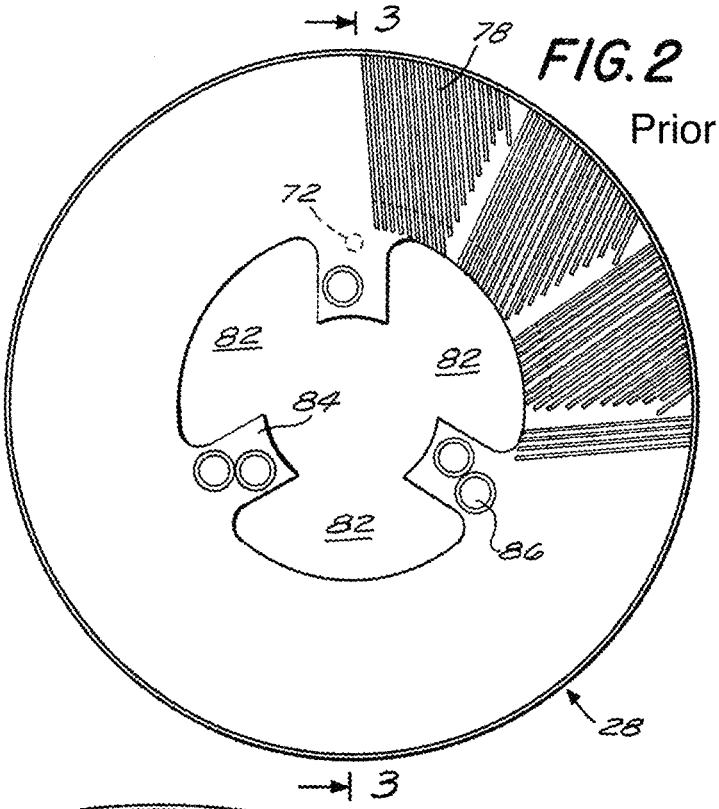
FIG. 2 Prior Art
FIG. 2 is a side view of the rotary refining member in the refiner of FIG. 1.
Figure 3:
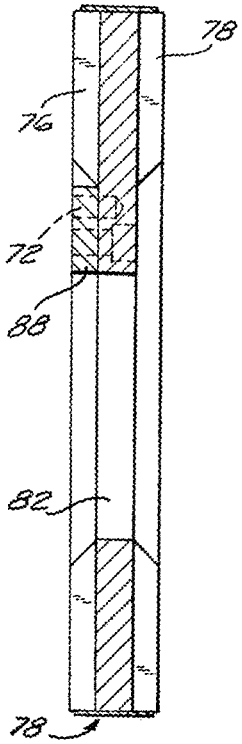
FIG. 3 Prior Art
FIG. 3 is an axial sectional view as seen in the direction of arrows from the line III-III of FIG. 2.

The discs 26, 28 and 28, 30 respectively define first and second paths P1 and P2 along which the pulp can advance from the inlet 18 toward the first outlet 20 (the second outlet 22 is assumed to be sealed when the refiner is in use). The path P1 is flanked by rib-shaped comminuting projections 74, 76 of the discs 26, 28, and the path P2 is flanked by rib-shaped comminuting projections 78, 80 of the discs 28, 30. The opening 56 of the disc 26 admits pulp from the inlet 18 into the central portion of the first path P1, and such pulp flows radially outwardly between the projections 74, 76 toward the outlet 20. The central portion of the disc 28, as shown in FIG. 2, has three kidney-shaped openings 82 whose combined cross-sectional area is less than the effective area of the opening 56. The openings 82 connect the path P1 with the path P2 so that some of the pulp which is admitted via opening 56 flows through the openings 82 and into the path P2 to be comminuted by the projections 78, 80 on its way toward the outlet 20. The openings 82 are partially separated from each other by radially inwardly extending portions 84 one of which has the blind bore 72 and each of which has one or more untapped bores 86 for the respective screws 66.

Figure 4:
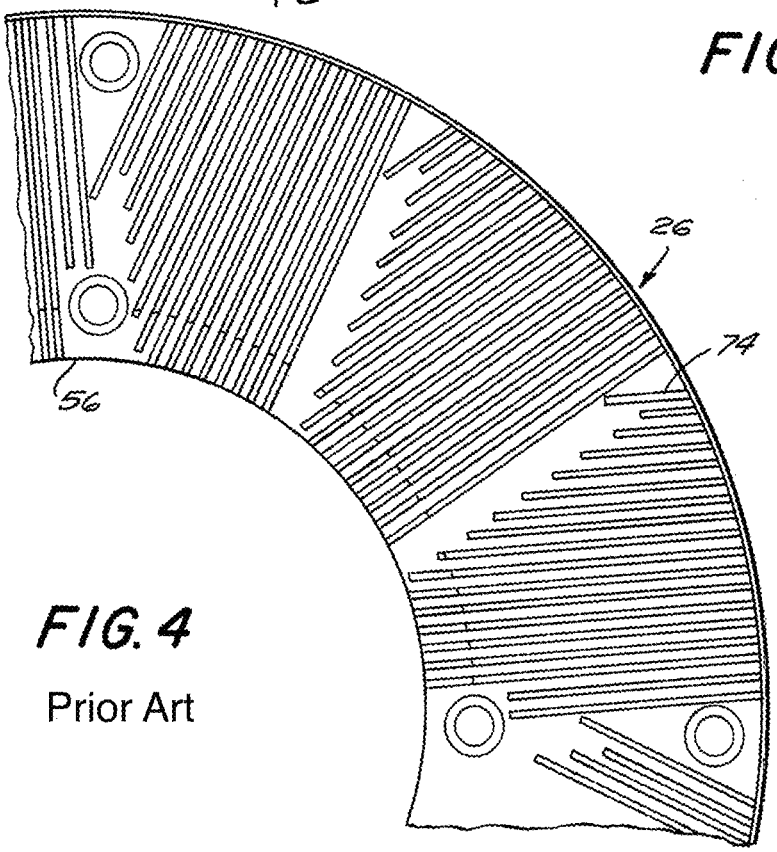
FIG. 4 Prior Art
FIG. 4 is a fragmentary side view of the first refining member in the refiner of FIG. 1.

FIG. 4 shows a portion of the disc 26 which may be identical with the disc 30. The diameter of the opening 56 in the disc 26 is about one-half the outer diameter of this disc. The effective area of the opening 56 is that area of this opening which surrounds the corresponding portion of the shaft 50. The combined effective area of the openings 82 in the disc 28 is smaller than the effective area of the opening 56 because the disc 28 receives the hub 58 and also because this disc is formed with the portions 84. However, the combined effective area of the openings 82 is large enough to ensure that the quantity of pulp which flows from the openings 82 into the path P2 is identical or practically identical with the quantity of pulp flowing from the opening 56 into the path P1.

Figure 5:
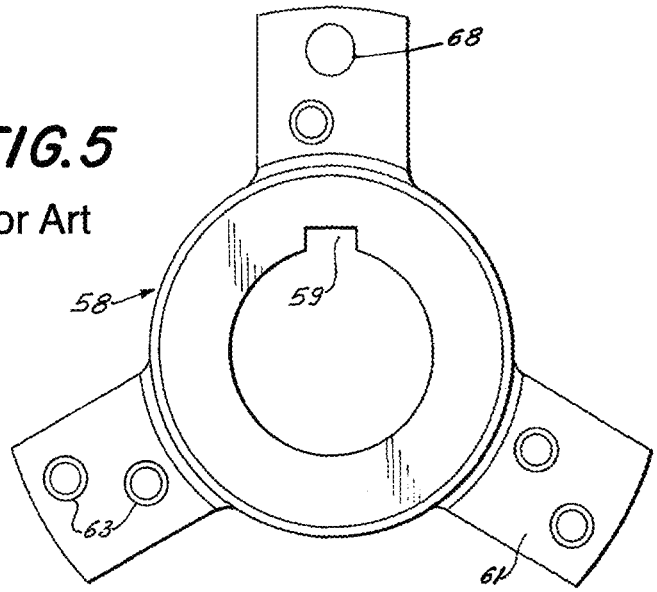
FIG. 5 Prior Art
FIG. 5 is an elevational view of a hub which forms part of the means for rotating the third refining member in the refiner of FIG. 1.

FIG. 5 shows the prior art hub 58. This hub has a keyway 59 for the key 60 and three radially outwardly extending arms 61 which overlie and are secured to the portions 84 of the disc 28. One of the arms 61 has the bore 68 for a portion of the guide pin 70 and each arm has at least one tapped bore 63 for the stem of the respective screw 66.

The Improved Assembly

Figure 6:
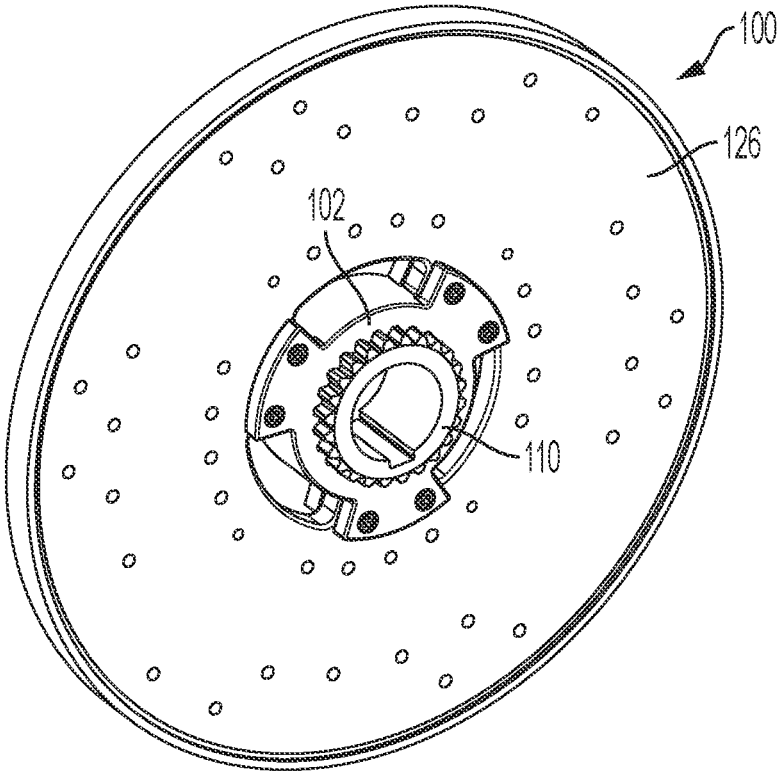
FIG. 6 is a rear side perspective view of an improved rotary refining member in the refiner of FIG. 1 according to this disclosure.
Figure 7:
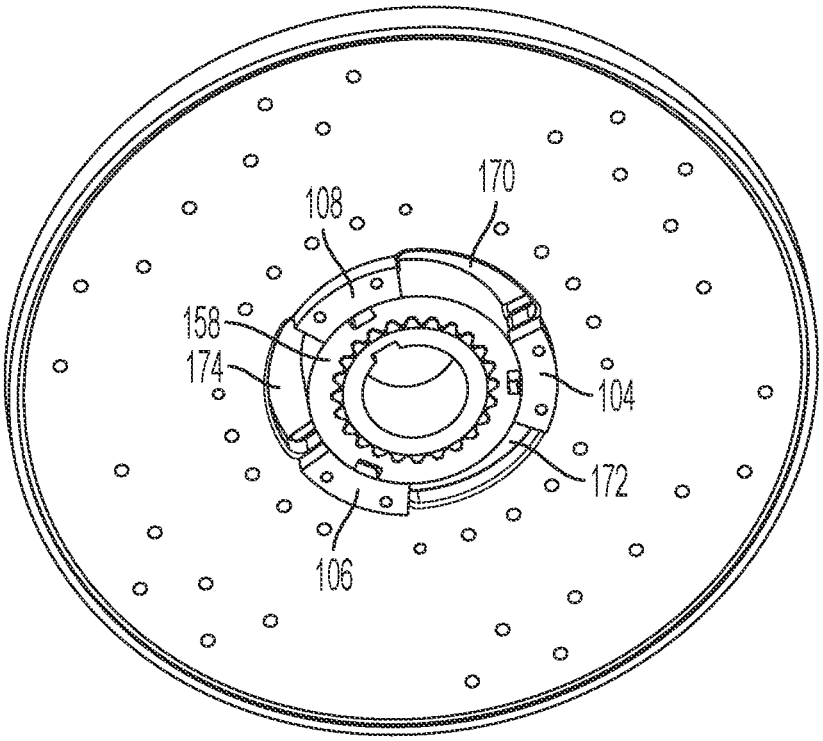
FIG. 7 is a front side perspective view of the improved rotary refining member of FIG. 6.

As illustrated in FIGS. 6 and 7, an improved assembly 100 according to this disclosure replaces the disc 28 and hub 58 of FIGS. 1 through 5 with an improved third refining member or disc 126, hub 158, an annular cover plate 102, at least two spaced apart port plates 104 and 106. In the preferred embodiment, the annular cover plate 102 and the hub 158 are an integral one piece.

In one embodiment, the improved assembly 100 further includes attaching means adapted to attach the hub to the drive shaft including a collar 110.

Figure 8:
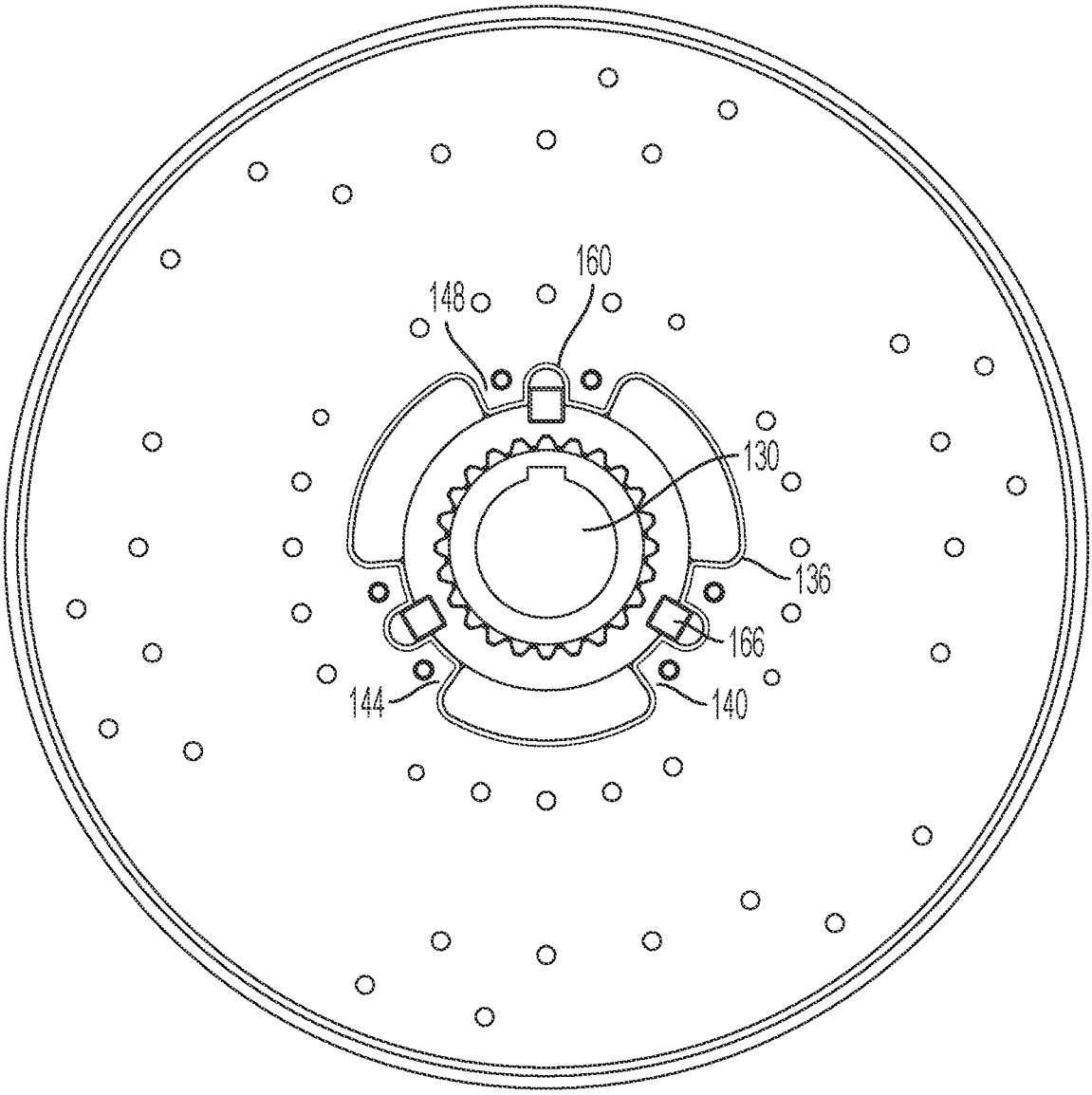
FIG. 8 is a front side view of the improved rotary refining member of FIG. 6 with port plates removed to show keys which extend between the annular disc and the hub.

The hub 158 is adapted to be rigidly connected to the drive shaft 50 and received in a third refining member central opening 130 so that the third refining member 126 is movable axially along the shaft 50, and the rotary third refining member 126 has a central opening 130 within a refining member inner surface 136 (see FIG. 8). As illustrated in FIG. 8, the rotary third refining member 126 has at least two equally spaced apart member portions 140 and 144 extending radially inwardly from the member inner surface 136. In a preferred embodiment, there are three equally spaced apart member portions 140, 144 and 148.

Figure 9:
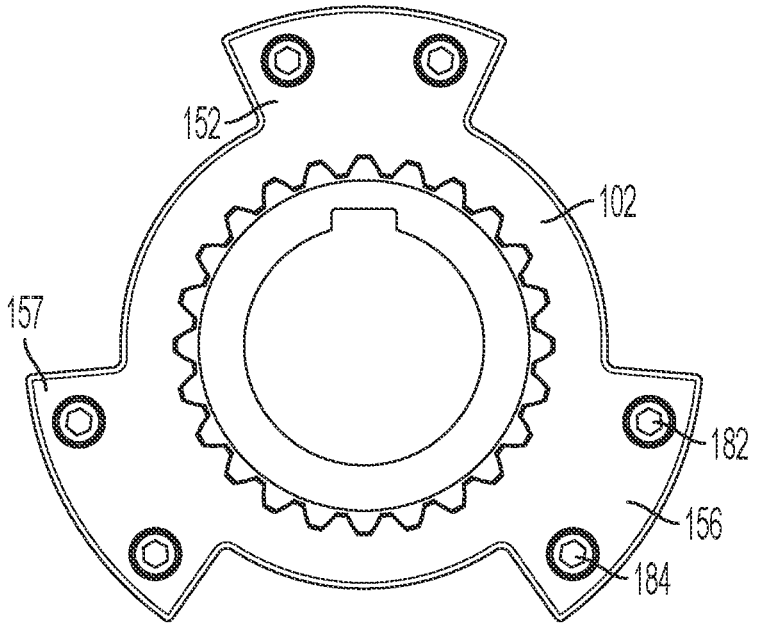
FIG. 9 is a rear side view of the hub of the improved rotary refining member of FIG. 6.
Figure 10:
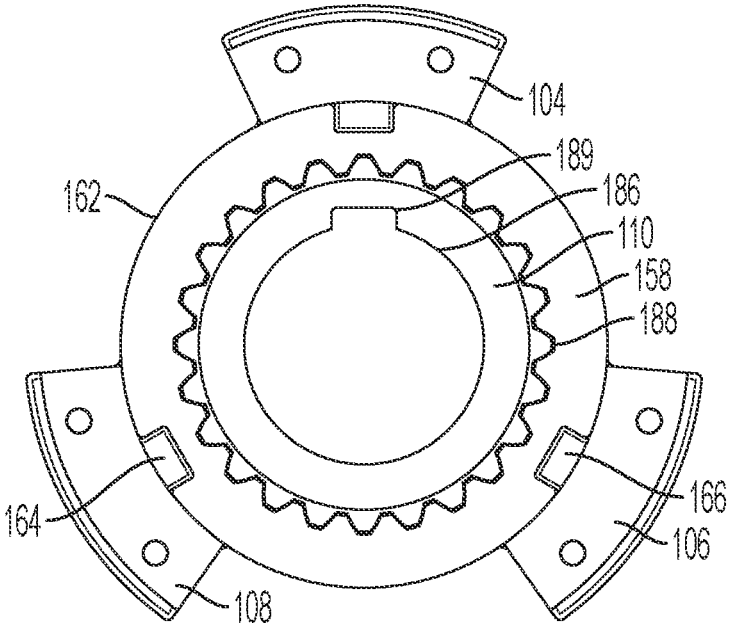
FIG. 10 is a front side view of the hub of the improved rotary refining member of FIG. 6.
Figure 11:
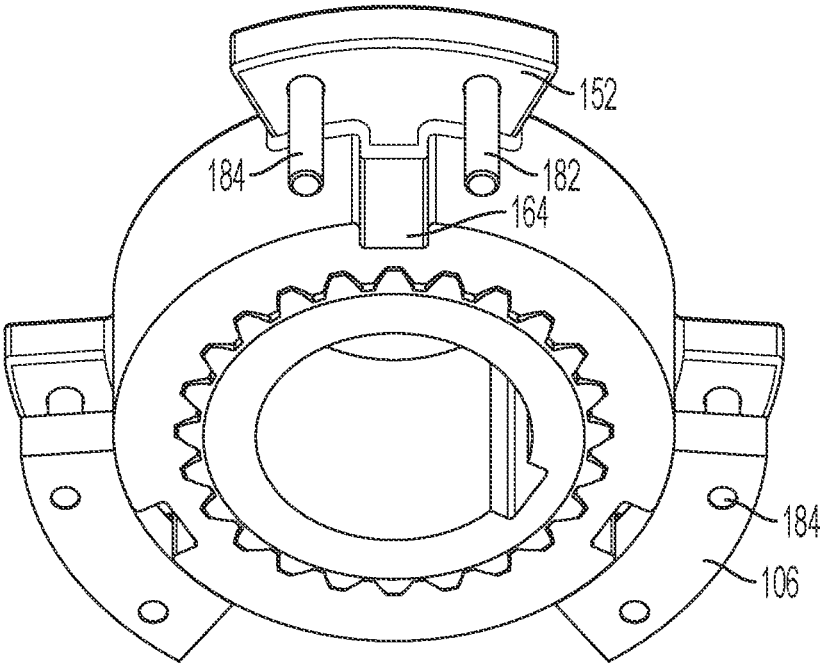
FIG. 11 is a front side perspective view of the hub of the improved rotary refining member of FIG. 6 with the port plates removed.
Figure 12:
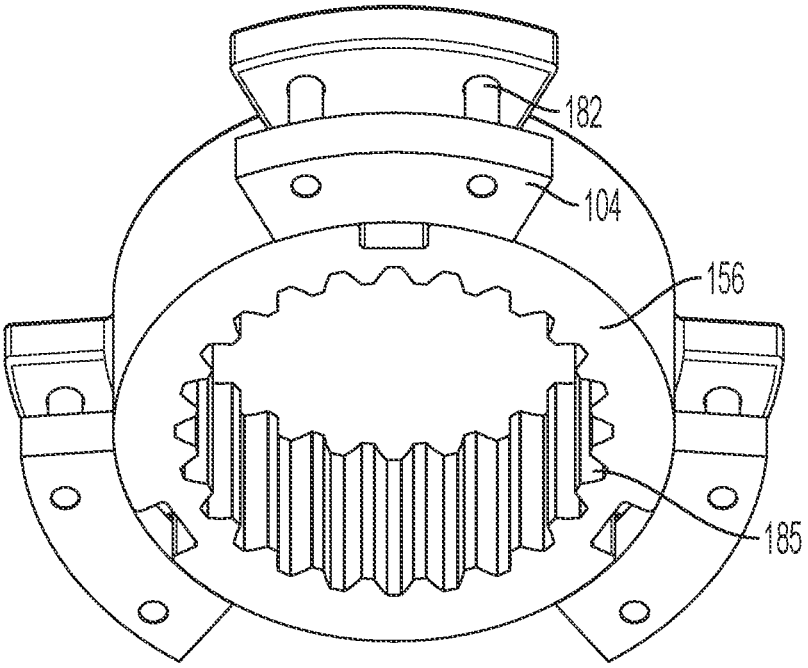
FIG. 12 is a front side perspective view of the hub of the improved rotary refining member of FIG. 6 with the port plates in place.

The improved assembly 100 further including connecting means for connecting the member portions 140, 144 and 148 to the hub 158, the connecting means comprising the annular cover plate 102 with at least two radially extending spaced apart flanges 152 and 156 (see FIG. 9), each flange overlying a member portion, and the at least two spaced apart port plates 104 and 106 (see FIG. 10), each port plate overlying a member portion side opposite the annular cover plate 102. In a preferred embodiment, there are three equally spaced apart port flanges 152, 156 and 157 and three equally spaced apart port plates 104, 106 and 108. In other less preferred embodiments (not shown), the spacing between the three port flanges need not be equal. The connecting means ensures the refining member 126 rotates with the hub 158 and the hub 158 remains in place on the refining member 126.

In one embodiment, the connecting means comprises each member portion having a portion key notch 160 (see FIG. 8), a hub outer surface 162 having a hub keyway 164 (see FIG. 10), and a key 166 received in each portion key notch 160 and each hub keyway 164.

Each port plate is secured in place relative to its respective member portion, and the spaces between the at least two port plates define spaced apart ports 170, 172 and 174 (see FIG. 7) from the first path to the second path. More particularly, in one embodiment, a pair of threaded bolts 182 and 184 pass through the cover plate 102, through corresponding openings in the member portion and into a threaded opening in the port plate, so that the cover plate, the member portion, the key, and the port plate together form a connected assembly 100.

In one embodiment, the attaching means comprises a spline on the hub inner surface 185, and the annular collar 110 having an outer surface 188 with a spline to engage the spline on the hub inner surface 185. The annular collar 110 also has an inner surface 186 with a collar keyway 189 for attachment to a key (not shown) engaging the drive shaft 50. In other less preferred embodiments, a spline or a keyway and key can be used in the alternative, and the collar and hub can be made as one piece.

Figure 15:
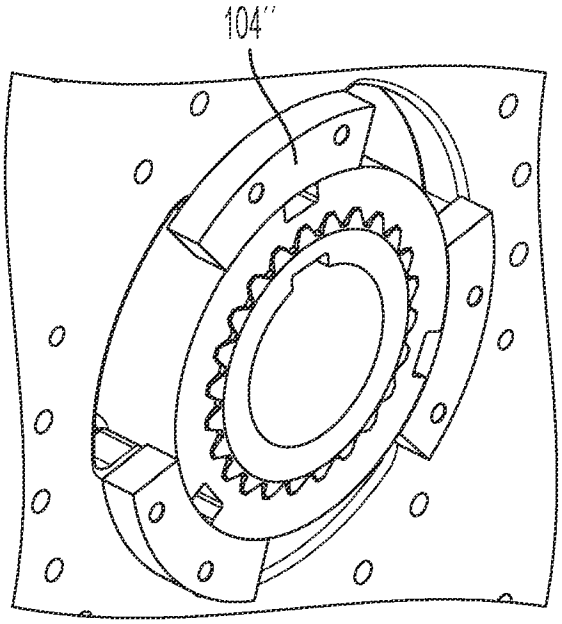
FIG. 15 is a fragmentary front perspective view of the rotary refining member of FIG. 6 with even larger port plates than in FIG. 14.
Figure 14:
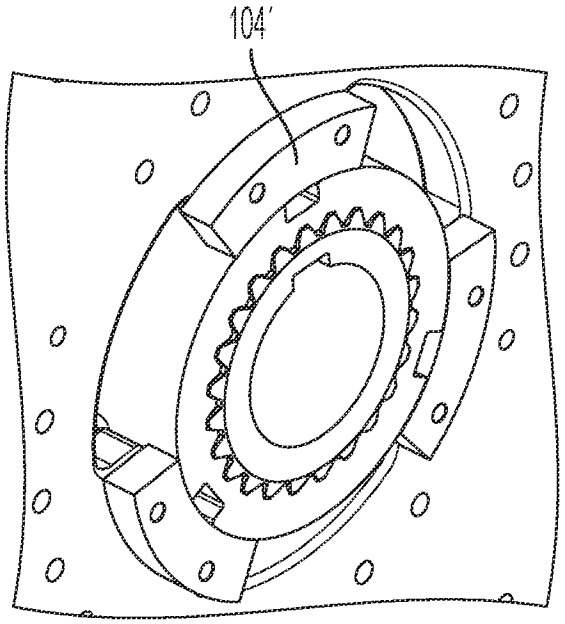
FIG. 14 is a fragmentary front perspective view of the rotary refining member of FIG. 6 with larger port plates than in FIG. 13.
Figure 13:
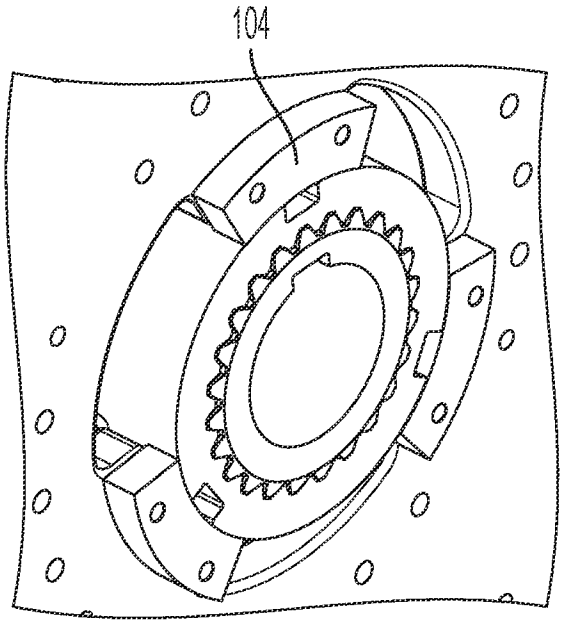
FIG. 13 is a fragmentary front perspective view of the rotary refining member of FIG. 6.

Also disclosed is a method for using the improved assembly 100, the method comprising the steps of defining a first size of the ports 170, 172 and 174 through the assembly 100 by providing a first port plate 104 (see FIG. 13) with a length which defines a first port size, and defining a second smaller size of the ports through the assembly 100 by providing a second port plate 104' (see FIG. 14) with a longer length. An even smaller size port is possible with an even larger port plate 104" (see FIG. 15). If port plates of both sizes are provided to a refiner customer, the customer can choose a port plate size appropriate based on the amount of stock flow the refiner is expected to experience in order to best equalize the stock flow on both sides of the refining member. Larger port plates will result in more stock in flow path P1, while smaller port plates will result in less stock in flow path P1.

This method provides substantial less additional metal than in the prior art without adding a further obstruction to the stock flow path between the third refining member and the other refining members.

The port plates also affect the direction of the flow path through the refining member. Different port plate shapes (not shown) can also be used to provide different flow path directions through the refining member.

Various other features and advantages of the invention will be apparent from the following claims.

The invention claimed is:

1. A refining member and hub assembly comprising an annular hub with a hub inner surface and a hub outer surface and a rotary refining member having a central opening, the assembly being configured to-be used in a refiner for pulp materials, the refiner including drive means configured to-rotate the refining member and comprising a drive shaft, the hub being configured to be rigidly connected to the drive shaft and received in the refining member central opening, wherein the refining member has at least two equally spaced apart member portions extending radially inward into the refining member central opening, the assembly further including connecting means for connecting the member portions to the hub, the hub including an annular cover plate with at least two radially extending spaced apart flanges, each flange overlying a first side of a respective one of the member portions, and at least two spaced apart port plates, each port plate overlying a member portion second side opposite the member portion first side, each port plate being secured in place relative to its respective member portion, spaces between the member portions and the at least two port plates defining material ports through the refining member.

2. A refiner for pulp materials comprising an annular hub with a hub inner surface and a hub outer surface and a rotary thrid refining member having a central opening within a refining member inner surface, a housing having a chamber, a material-admitting inlet and an outlet; spaced apart first and second refining members mounted in the chamber; the rotary third refining member being disposed in the chamber between the first and second refining members, the first, second and refining members being coaxial with each other, with a first path for movement of material from the inlet being defined between the first and third refining members, with a second path for movement of material to the outlet being defined between the third and second refining members, the first and second refining members respectively having first and second comminuting projections adjacent to the first and second paths and the third refining member having third and fourth comminuting projections adjacent to the first and second paths and respectively cooperating with the first and second projections to refine the material flowing along the first and second paths, the refiner further including drive means to rotate the third refining member and comprising a drive shaft, the hub being rigidly connected to the drive shaft and received in the third refining member central opening, wherein the refining member has at least two equally spaced apart member portions extending radially inwardly from the member inner surface, connecting means for connecting the member portions to the hub, the hub including an annular cover plate with at least two radially extending spaced apart flanges, each flange overlying a member portion, at least two spaced apart port plates, each port plate overlying a member portion side opposite the annular cover plate, each port plate being secured in place relative to its respective member portion, spaces between the at least two port plates defining ports from the first path to the second path, and attaching means to attach the hub to the drive shaft.

3. The assembly according to claim 1 wherein the hub is configured to-be rigidly connected to the drive shaft and received in the refining member central opening so that the refining member is movable axially along the drive shaft.

4. The assembly according to claim 1 wherein the hub has a spline on the hub inner surface, and the hub includes an annular collar having an outer surface with a spline to engage the spline on the hub inner surface, the annular collar also having an inner surface with a collar keyway.

5. A method comprising the steps of:

utilizing the refining member and hub assembly of claim 1 to define a first size of material ports through the assembly by providing a first port plate with a length which defines a first port size, and utilizing the refining member and hub assembly of claim 1 to define a second smaller size of the material ports through the assembly by providing a second port plate with a longer length to define a smaller second port size.

6. A refining member and hub assembly comprising an annular hub with a hub inner surface and a hub outer surface and a rotary refining member having a central opening, the assembly being configured to-be used in a refiner for pulp materials, the refiner further including drive means configured to-rotate the refining member and comprising a drive shaft, the hub being configured to-be rigidly connected to the drive shaft and received in the refining member central opening, wherein the refining member has at least two equally spaced apart member portions extending radially inward into the refining member central opening, the assembly further including connecting means for connecting the member portions to the hub, the hub including an annular cover plate with at least two radially extending spaced apart flanges, each flange overlying a first side of a respective one of the member portions, and at least two spaced apart port plates, each port plate overlying a member portion second side opposite the member portion first side, each port plate being secured in place relative to its respective member portion, spaces between the member portions and the at least two port plates defining material ports through the refining member, wherein each member portion has a portion key notch, the hub outer surface having a hub keyway, and a key is received in each portion key notch and each hub keyway.

7. The assembly according to claim 6 wherein there are at least three equally spaced apart member portions.

8. The assembly according to claim 7 wherein a threaded bolt passes through the cover plate, through corresponding openings in a respective member portion and into a threaded opening in a respective port plate, so that the cover plate, the member portion, the key, and the respective port plate together comprise a connected assembly.

9. The assembly according to claim 6 wherein the hub has a spline on the hub inner surface, and the hub includes an annular collar having an outer surface with a spline to engage the spline on the hub inner surface, the annular collar also having an inner surface with a collar keyway.

10. A method comprising the steps of:

utilizing the refining member and hub assembly of claim 6 to define a first size of the material ports through the assembly by providing a first port plate with a length which defines a first port size, and utilizing the refining member and hub assembly of claim 6 to define a second smaller size of the material ports through the assembly by providing a second port plate with a longer length to define a smaller second port size.

11. The refiner according to claim 2 wherein the drive shaft extends through a central opening provided in the first refining member.

* * * * *